US007270069B1

(12) United States Patent
Thibodeau et al.

(10) Patent No.: US 7,270,069 B1
(45) Date of Patent: Sep. 18, 2007

(54) TORPEDO MOUNTED DISPENSER

(75) Inventors: Robert C. Thibodeau, Wakefield, RI (US); David A. Abdow, Somerset, MA (US); George M. Kotas, Exeter, RI (US)

(73) Assignee: The United States of America represented by the Secretary of the Navy, Washington, DC (US)

( * ) Notice: Subject to any disclaimer, the term of this patent is extended or adjusted under 35 U.S.C. 154(b) by 77 days.

(21) Appl. No.: 11/183,312

(22) Filed: Jul. 11, 2005

(51) Int. Cl.
*F42B 19/00* (2006.01)

(52) U.S. Cl. ..... 114/238; 114/20.1

(58) Field of Classification Search ..... 114/238, 114/239, 21.1, 21.2, 246, 253; 89/1.81, 1.816; 244/588.3, 588.6, 593, 597, 597.1, 3.12
See application file for complete search history.

(56) References Cited

U.S. PATENT DOCUMENTS 3,387,537 A * 6/1968 Chakoian et al. ..... 89/1.51
3,703,874 A * 11/1972 Lemieux ..... 114/21.1
3,831,941 A 8/1974 Pease
3,963,226 A 6/1976 Jankowski, Jr.
4,685,412 A * 8/1987 Harris et al. ..... 114/238
5,065,688 A * 11/1991 Moody ..... 114/238
5,385,109 A 1/1995 Hrycin et al.
5,690,044 A * 11/1997 Reise et al. ..... 114/238
5,996,930 A * 12/1999 Katayama et al. ..... 242/593
6,242,684 B1 6/2001 Oliver et al.
6,418,870 B1 * 7/2002 Lanowy et al. ..... 114/238
6,499,417 B2 * 12/2002 Oliver et al. ..... 114/238
6,502,522 B1 * 1/2003 Doleski et al. ..... 114/21.2

* cited by examiner

*Primary Examiner*—Troy Chambers
*Assistant Examiner*—Stewart Knox
(74) *Attorney, Agent, or Firm*—James M. Kasischke; Jean-Paul A. Nasser; Michael P. Stanley

(57) ABSTRACT

The present invention is a dispenser mounted on the aft section of a torpedo for deploying an elongated, flexible article along a deployment axis. There is a molded elastomeric encasement over the exterior perimeter of the outer weldment of the dispenser for providing shock, impact, and force protection to the dispenser. A metal stiffener plate is secured to the top portion of the encasement for distributing localized compressive loads on weak sections of the dispenser. The encasement together with the stiffener plate enlarges the dispenser to approximately the same outer diameter as the torpedo to which it is attached. The encasement incorporates a fore and aft groove at a lower position with small notches for positioning and anchoring a torpedo power cable. The encasement further incorporates a pivoting retention door assembly for restraining the torpedo power cable within the groove in the encasement.

4 Claims, 6 Drawing Sheets

TORPEDO MOUNTED DISPENSER

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates to marine vessels and more particularly to use with a wire guided torpedo.

(2) Brief Description of the Prior Art

The U.S. Navy utilizes a Torpedo Mounted Dispenser (TMD) as an integral part of its guidance wire communication system. The function of the torpedo mounted dispenser is to house a guidance wire coil and allow for successful deployment of a hollow core flexible cable known as a flex-hose that is used to position the guidance wire that is paying out through it, below the submarine's keel and propeller. A prior art torpedo mounted dispenser is disclosed in U.S. Pat. No. 5,385,109, the contents of which are incorporated herein by reference.

The torpedo mounted dispenser is attached to the rear of the torpedo prior to loading the torpedo onboard the submarine and is stowed along with the torpedo inside of the submarine's torpedo room. Torpedoes are presently secured on U.S. Naval submarine weapon stowage and handling systems (WSHS) by means of four dollies equipped with lashing straps. However, there exist five locations to secure weapons on all submarine classes. On some submarine classes, the location of the fifth dolly and lashing straps is in line with the torpedo mounted dispenser.

Currently the fifth dolly and lashing strap cannot be used to stow a torpedo, because the existing torpedo mounted dispenser structure has been determined to be too small and also too weak to support the required static clamping forces of the fifth lashing strap when stowed within a submarine's WSHS. However, a torpedo mounted dispenser whose diameter is enlarged and whose structure is reinforced by an elastomeric encasement around the exterior of the outer weldment can be secured to the fifth dolly by the fifth lashing strap. What is needed then is an improved torpedo mounted dispenser that is larger and structurally capable of supporting the required static clamping forces of a fifth lashing strap when stowed within a submarine's WSHS.

SUMMARY OF THE INVENTION

It is an object of the present invention to provide an improved torpedo mounted dispenser structure large enough and capable of withstanding the required static clamping forces of a fifth lashing strap when stowed within a submarine's WSHS.

This object is accomplished with the present invention by incorporating an elastomeric encasement around the exterior of the torpedo mounted dispenser as a means for providing shock, impact, and force protection to the torpedo mounted dispenser outer weldment and enlarging the torpedo mounted dispenser to the same outer diameter as the torpedo to which the torpedo mounted dispenser is attached.

The torpedo mounted dispenser of this invention consists of a hard durable elastomeric encasement positioned over the prior art torpedo mounted dispenser outer weldment, thus creating an enlarged outer torpedo mounted dispenser diameter, similar to that of the torpedo. The elastomeric covering acts to increase the diameter and structural integrity of the torpedo mounted dispenser by maintaining the concentric annulus cavity that the flex-hose is coiled in and provides a hard and semi-rigid surface that can support the tightening torques of the WSHS fifth lashing straps and contact pads that would otherwise deform the prior art torpedo mounted dispenser weldment. The improved torpedo mounted dispenser of this invention provides an additional torpedo restraining location that provides additional shock hardening benefit to the MK 48 TORPEDO.

BRIEF DESCRIPTION OF THE DRAWINGS

Other objects, features and advantages of the present invention will become apparent upon reference to the following description of the preferred embodiments and to the drawing, wherein corresponding reference characters indicate corresponding parts in the drawing and wherein.

DETAILED DESCRIPTION OF THE PREFERRED EMBODIMENT

Figure 1:
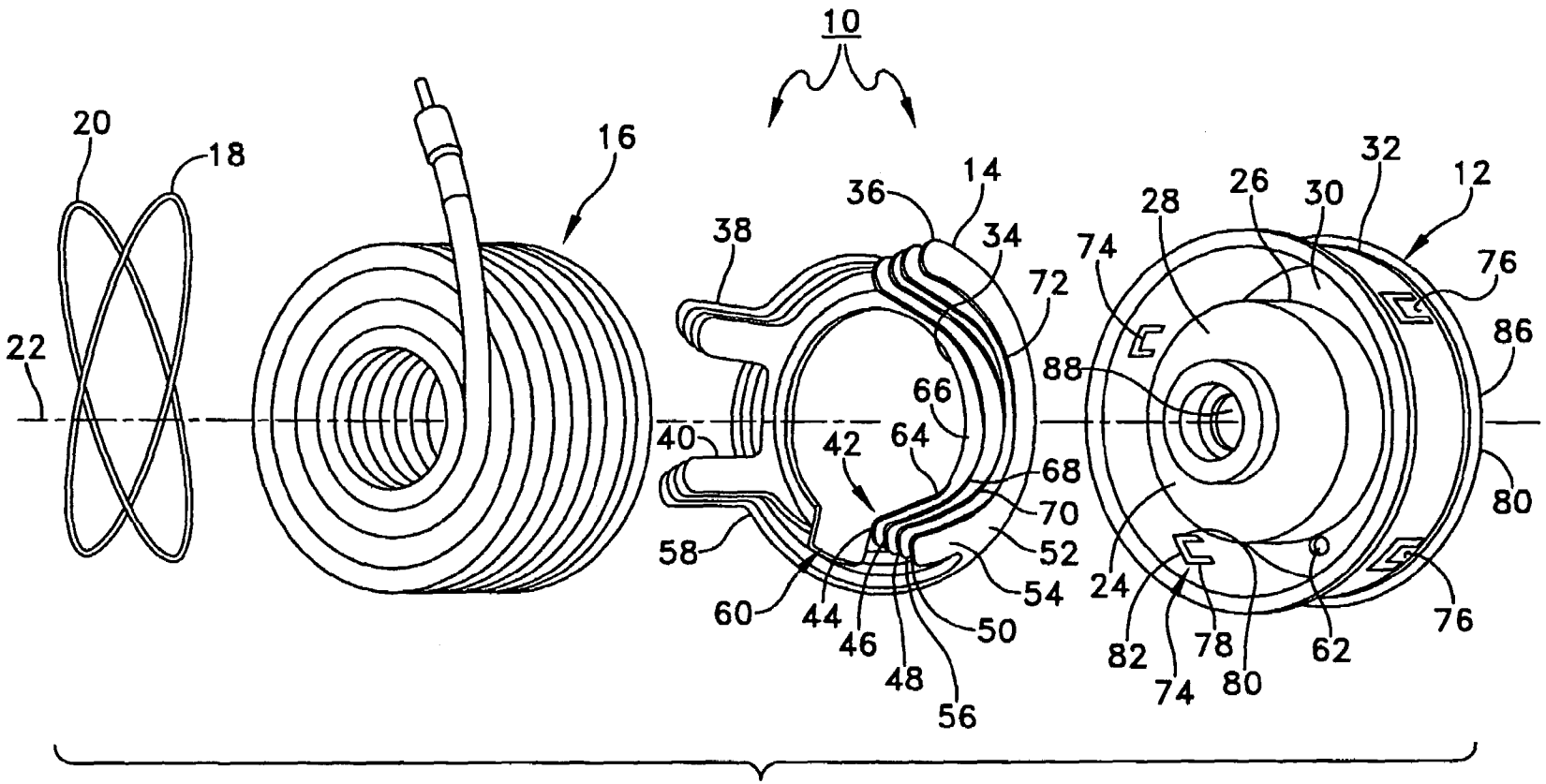
FIG. 1 is a fragmented perspective view of a preferred embodiment of the dispenser of the present invention with details of lifting handles and side pad assemblies being omitted.
Figure 2:
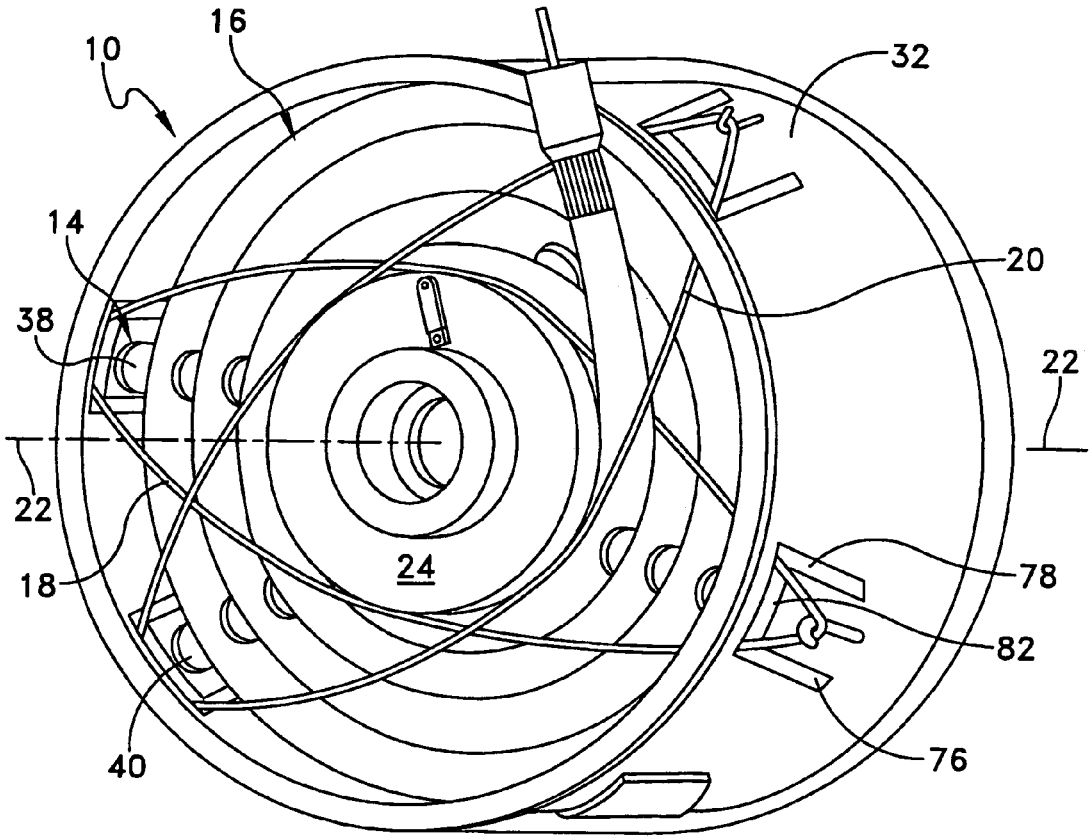
FIG. 2 is a perspective front view of the dispenser shown in FIG. 1.

Referring to FIGS. 1 and 2, a torpedo mounted dispenser 10 as described in U.S. Pat. No. 5,385,109, includes open-ended receptacle 12, and a partitioning insert 14 for storing an elongated flexible hose 16 with an internal conductor or conductors as a multi-turn, multi-layer coil. The restraining bands 18 and 20 complete the dispenser 10. These components are mounted together coaxially about a deployment axis 22 that is generally horizontal in a submarine application. The dispenser 10 includes a cylindrical hub 24 that contains, within cylindrical wall 26 and an end wall 28, various mounting hardware for connection to a torpedo and submarine torpedo launch tube. Base plate 30 extends radially from one end of the hub 24 to support a cylindrical shaped outer weldment 32 that is concentric with and spaced from the cylindrical wall 26. The partitioning insert 14 is molded or cast with an annular base 34 that attaches or butts against the base plate 30 or dispenser 10. The partitioning insert 14 includes four finger sets 26, 28, 40 and 42 that are perpendicular to base 34. Each of the finger sets includes radially inner finger sets 44, intermediate finger sets 46 and 48 and radially outer finger sets 50. Each finger has, for example, a base portion 52, and intermediate portion 54, and a free end 56. An arcuate extension 58 is positioned between the base portion 52 and a base portion of an adjacent finger. There are no extensions between finger sets 40 and 42 as this area constitutes a transition area 60 in which the flexible hose 16 can transfer smoothly between adjacent channels to produce a multi-turn layer and multiple layers. In addition, the opening 62 in base plate 30 permits the other end of the flexible hose 16 to be lead through base plate 30 for connection to a retaining device on the rear of dispenser 10. The circumferentially spaced sets of fingers define a series of concentric channels shown at 66, 68, 70 and 72. The cylindrically shaped outer weldment 32 contains approximately four diametrically opposite notches 74 for passing through restraining bands 20 and 18. These notches are comprised of leg slots 78 and 80 and cross-slots 82.

Figure 3:
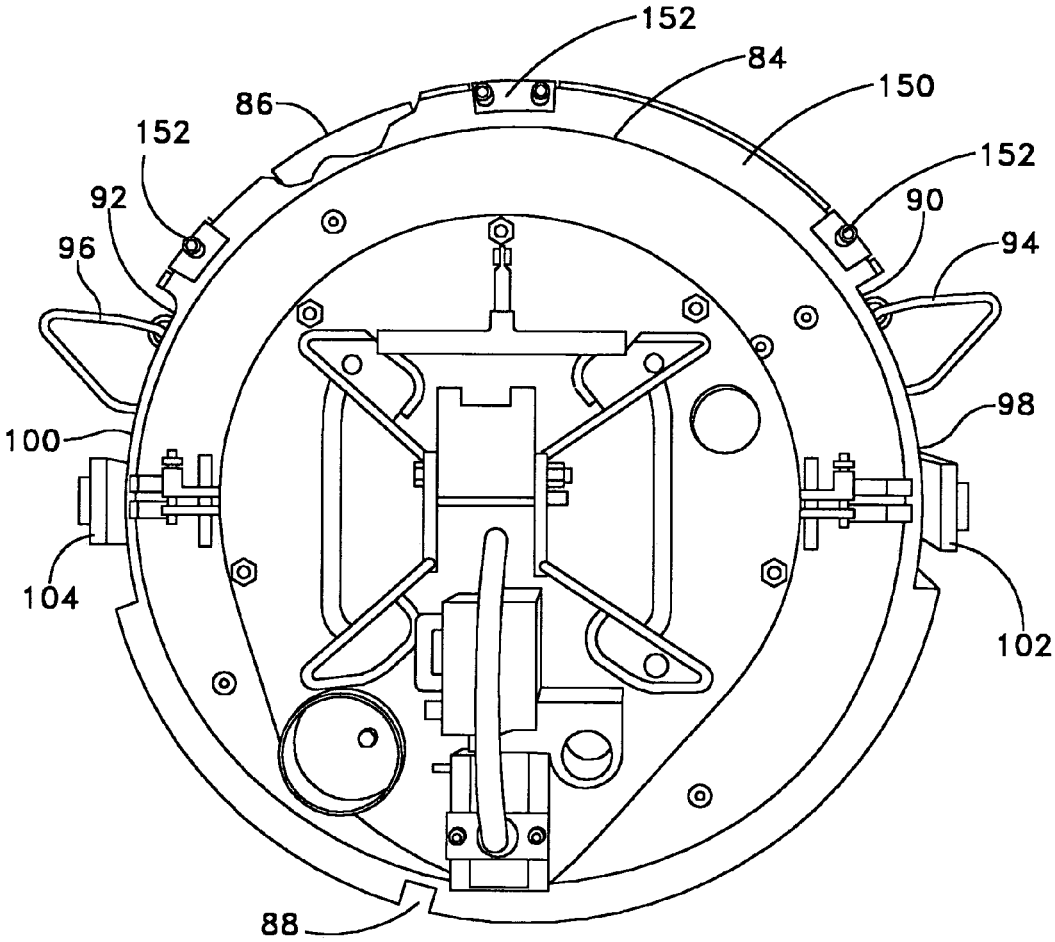
FIG. 3 is a perspective rear view of the dispenser shown in FIG. 2 with an elastomeric encasement incorporated over its outer diameter and a metal stiffener plate.
Figure 4:
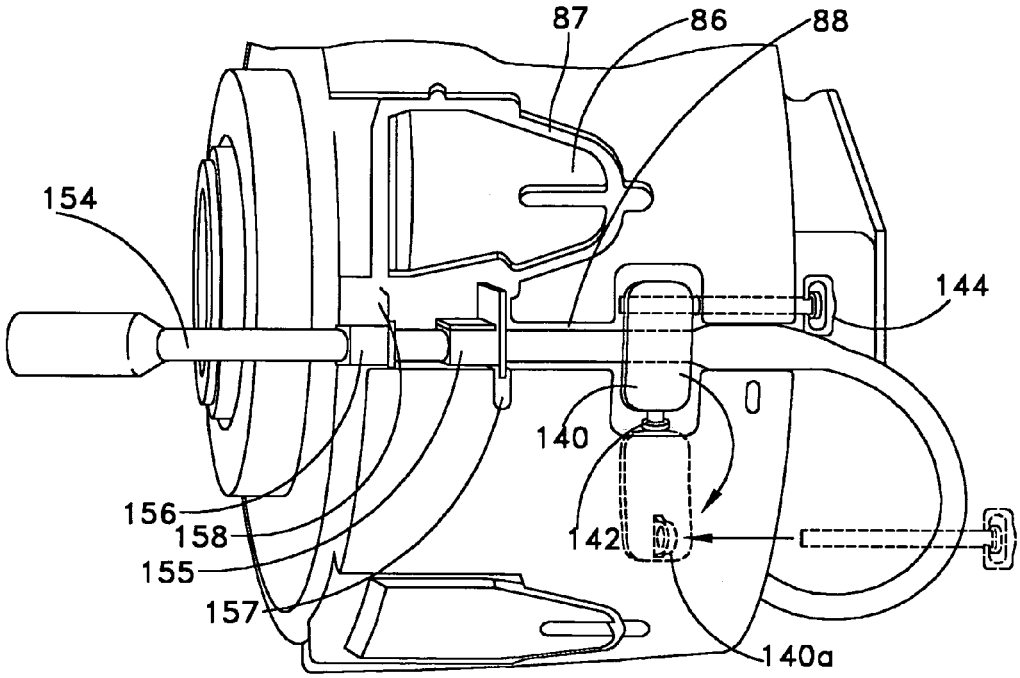
FIG. 4 is a retention door assembly and retention slot.

Referring now to FIGS. 3 and 4, in conjunction with FIGS. 1 and 2, cylindrically shaped outer weldment 32 is encased by a hard and durable elastomeric encasement 84 incorporated into the torpedo mounted dispenser, which provides for a design inherent strengthening and hardening feature to protect the dispenser 10 from explosion induced shock and impact events and provide force protection. The encasement 84 is molded and contoured to the cylindrically shaped outer weldment 32 to prevent any vibration of the outer weldment 32. The elastomeric encasement 84 incorporates four approximately diametrically opposed notches 86 that are in line with notches 74 having leg slots 78 and 80 and cross-slots 82. To allow passage of restraining bands 18 and 20 through cylindrically shaped outer weldment 32, the elastomeric encasement incorporates internal groove sets 87 within notches 86 for securing restraining bands 18 and 20 that are used to restrain the elongated flexible cable 16 within the dispenser 10. The outer weldment 32 and elastomeric encasement 84 incorporate an axial retention slot 88 for housing and securing a torpedo power cable 154.

Referring to FIG. 4, the torpedo power cable 154 is held in the retention slot 88 by means of a retention door assembly that includes retention door 140, pivot pin 142 and release pin 144. Retention door 140 is hinged by pivot pin 142 such that it opens and closes across retention slot 88. When retention door 140 is closed, it holds the torpedo power cable in place within retention slot 88. Retention door 140 is curved in shape so that when it closes, it is approximately flush with the curvature of encasement 84. Retention door 140 has an aperture 140*a* at one end to receive the release pin 144. The release pin 44 slides into the encasement 84 and into the aperture 140*a* to hold the retention door 140 in the closed position. The power cable 154 is anchored and prevented from sliding fore and aft in retention slot 88 by means of restraining clips 155 and 156 on torpedo power cable 154 that fit within the narrow horizontal slots 157 and 158 that are incorporated within encasement 84.

Figure 5:
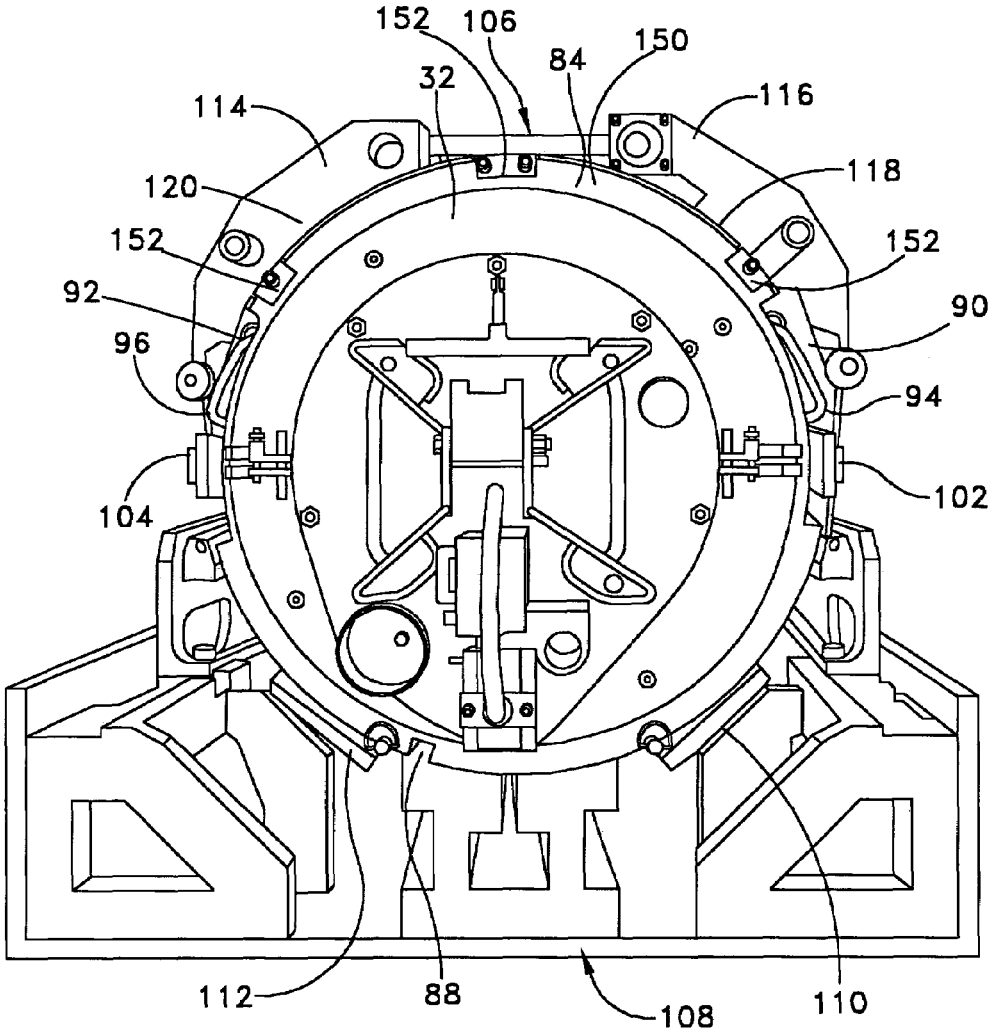
FIG. 5 is a rear view partially in perspective of the dispenser shown in FIG. 3 shown lashed in a weapon cradle.

Referring to FIG. 3 and FIG. 5, the top of the encasement 84 is covered by a stiffener plate assembly. The assembly includes a metal stiffener plate 150 that is fabricated to fit over the curved shape of encasement 84. The metal stiffener plate 150 is held to the encasement 84 by a series of mounting fasteners 152. The metal stiffener plate 150 is designed to distribute the load placed upon the encasement 84 from lashing straps 114 and 116 that contact the upper two diametrically opposite notches 74.

Cut out sections 90 and 92 of the encasement 84 are incorporated for installation of lifting handles 94 and 96 such that they do not protrude beyond the overall outside diameter of the elastomeric encasement 84. Cut out sections 90 and 92 in conjunction with cut out sections 98 and 100 are incorporated into the encasement 84 to facilitate installation of locking pad mechanisms 102 and 104 respectively that are affixed to outer weldment 32 and the rear of base 30. Locking pad mechanisms 102 and 104 are used to secure the dispenser 10 in a submarine's torpedo tube.

Referring to FIG. 5, the invention, when secure within a fifth weapon dolly and lashing strap, includes the dispenser 10 with the elastomeric encasement 84 and stiffener plate assembly supported by weapon dolly section 106 and weapon dolly section 108 containing contact pad 110 and contact pad 112 and lashing strap 114 and lashing strap 116 containing contact pad 118 and contact pad 120. The lashing straps 114 and 116 are tightened against the outer surface of the metal stiffener plate 150 covering the elastomeric encasement 84 on dispenser 10 by mechanical means. The torpedo mounted dispenser is held firmly in position by the upper contact pads 118 and 120, and lower contact pads 110 and 112 by localized compressive forces. The elastomeric encasement 84 distributes the localized stress around its structure providing a strengthened dispenser 10.

Figure 6:
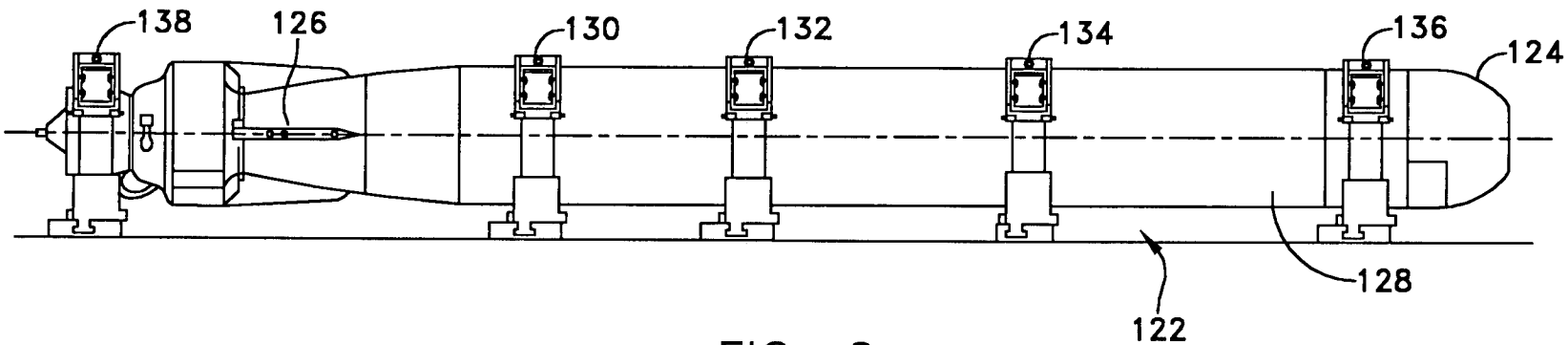
FIG. 6 is a side elevation view of a torpedo on which the dispenser shown in FIG. 4 is mounted and secured by the fifth WSHS dolly and lashing strap.

Referring to FIG. 6, there is illustrated a torpedo 122 with a forward end 124 and an aft end 126, and a longitudinal axis 128. The torpedo 122 is retained by torpedo lashing straps and dollies 130, 132, 134 and 136. There is also a fifth lashing strap, the aft lashing strap 138, that secures the aft end 126 of the torpedo by lashing the improved torpedo mounted dispenser of this invention In alternative embodiments, different types of protective and strengthening encasement materials may be incorporated into the encasement in lieu of elastomer. Non-limiting examples of such materials include composites, ceramics, steels and other such materials, which will be readily apparent to those of ordinary skill in the art. The composites may be composites of metallic and polymeric materials or of carbon and polymeric fibers and/or materials.

In other alternative embodiments, encasements may have a uniform thickness or a varying thickness.

In other alternative embodiments, the torpedo mounted dispenser may be only partially enclosed by the encasement.

In another alternative embodiment, the encasement material may be applied on the inside of the torpedo mounted dispenser structure as opposed to the outside surface.

In other alternative embodiments, the encasement could include other features known to those of ordinary skill in the art to provide electrical isolation, provide vibration dampening, and reduce operational frictional forces.

It will be appreciated that an elastomeric covering has been described that enlarges and reinforces a torpedo mounted dispenser structure to provide a means for shock impact force protection by hardening and strengthening the torpedo mounted dispenser structure. The elastomeric covering incorporates the necessary cutouts and clearances for the torpedo mounted dispenser locking pad assemblies that secure the torpedo mounted dispenser in the torpedo tube, a channel for routing and securing the torpedo power cable and torpedo mounted dispenser flex-hose restraining bands.

The advantage of the encasement of the present invention is that it overcomes the disadvantages of proposed attachable reinforcements to the torpedo mounted dispenser. The installation of attachable reinforcements impact either the time it takes to overhaul a torpedo mounted dispenser by the torpedo mounted dispenser depots or the time required to prepare torpedoes for loading on board submarines.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A weapon stowage and handling system for a torpedo, said torpedo having a forward end, an aft end, a longitudinal axis and a dispenser for deploying an elongated, flexible article mounted on the aft end of said torpedo, said weapon stowage and handling system having at least five axially spaced dollies each of which has a plurality of torpedo lashings designed to lash the torpedo, wherein at least one of the torpedo lashings is lashed to the dispenser said dispenser further comprising:

an open-ended cylindrical receptacle for storing the elongated, flexible article in a multiple-turn, multiple-layer configuration about the deployment axis in a storage volume within said open-ended cylindrical receptacle wherein said open-ended cylindrical receptacle has an outer surface with lift handles and locking pad mechanisms; and an encasement, made of a hardened elastomeric material that provides mechanical reinforcement, around the periphery of the outer surface of the open-ended cylindrical receptacle wherein the encasement serves to strengthen the structural integrity of the open-ended cylindrical receptacle against the at least one of the torpedo lashings and wherein the combined diameter of the open-ended cylindrical receptacle and encasement is approximately the same as the diameter of the torpedo.

2. The weapon stowage and handling system of claim 1 wherein said encasement is directly and permanently molded to the periphery of outer surface of the open-ended cylindrical receptacle in order to follow the contours of the open-ended cylindrical receptacle.

3. The weapon stowage and handling system of claim 2 wherein the hardened elastomeric encasement is an electrical insulator and has four approximately diametrically opposed notches with internal groove sets.

4. The weapon stowage and handling system of claim 3 wherein the encasement further comprises:

an axial retention slot to contain a flexible cable;

a retention door assembly for retaining said flexible cable within said retention slot; and a plurality of cut out sections wherein at least a first pair of said plurality of cut out sections surround the lift handles and wherein at least a second pair of said plurality of cut out sections surrounded the locking pad mechanisms.

* * * * *